US010899990B2

(12) United States Patent
Sawaguchi et al.

(10) Patent No.: US 10,899,990 B2
(45) Date of Patent: Jan. 26, 2021

(54) LUBRICATING GREASE COMPOSITION

(71) Applicant: NOK KLUEBER CO., LTD., Tokyo (JP)

(72) Inventors: Wataru Sawaguchi, Kita Ibaraki (JP); Kohei Matsumoto, Kita Ibaraki (JP)

(73) Assignee: NOK KLUEBER CO., LTD., Tokyo (JP)

( * ) Notice: Subject to any disclaimer, the term of this patent is extended or adjusted under 35 U.S.C. 154(b) by 0 days.

(21) Appl. No.: 16/269,890

(22) Filed: Feb. 7, 2019

(65) Prior Publication Data

US 2019/0169522 A1 Jun. 6, 2019

Related U.S. Application Data

(63) Continuation of application No. PCT/JP2017/026102, filed on Jul. 19, 2017.

(30) Foreign Application Priority Data

Aug. 8, 2016 (JP) ..... 2016-155404

(51) Int. Cl.

| | |
|---|---|
| ***C10M 169/02*** | (2006.01) |
| ***C10M 101/02*** | (2006.01) |
| ***C10M 107/02*** | (2006.01) |
| ***C10M 169/06*** | (2006.01) |
| ***C10M 125/10*** | (2006.01) |
| ***C10M 117/02*** | (2006.01) |
| ***C10M 105/04*** | (2006.01) |
| ***C10M 117/00*** | (2006.01) |
| ***C10N 20/02*** | (2006.01) |
| ***C10N 20/06*** | (2006.01) |

(52) U.S. Cl.

CPC ..... *C10M 169/02* (2013.01); *C10M 101/02* (2013.01); *C10M 107/02* (2013.01); *C10M 117/02* (2013.01); *C10M 125/10* (2013.01); *C10M 169/06* (2013.01); *C10M 105/04* (2013.01); *C10M 117/00* (2013.01); *C10M 2201/0623* (2013.01); *C10M 2207/1206* (2013.01); *C10M 2207/1256* (2013.01); *C10N 2020/02* (2013.01); *C10N 2020/06* (2013.01)

(58) Field of Classification Search

CPC ..... C10M 101/02; C10M 105/04; C10M 107/02; C10M 117/00; C10M 117/02; C10M 125/10; C10M 169/02; C10M 169/06; C10M 2201/0623; C10M 2207/1206; C10M 2207/1256; C10N 2020/02; C10N 2040/20; C10N 2250/10

See application file for complete search history.

(56) References Cited

U.S. PATENT DOCUMENTS

| | | | | |
|---|---|---|---|---|
| 5,093,015 | A * | 3/1992 | Oldiges | C10M 169/06 508/124 |
| 2003/0176298 | A1* | 9/2003 | Nakatani | C10M 123/06 508/398 |
| 2011/0082060 | A1* | 4/2011 | Faci | C10M 169/06 508/161 |
| 2011/0218128 | A1* | 9/2011 | Hishinuma | C10M 169/02 508/181 |
| 2015/0045272 | A1* | 2/2015 | Fujimaki | C10M 169/06 508/503 |

FOREIGN PATENT DOCUMENTS

| | | | |
|---|---|---|---|
| EP | 2 133 407 | A1 | 12/2009 |
| JP | 10259392 | A * | 9/1998 |
| JP | 11-035963 | A | 2/1999 |
| JP | 11-124591 | A | 5/1999 |
| JP | 11-131086 | A | 5/1999 |
| JP | 2003-013083 | A | 1/2003 |
| JP | 2003-301190 | A | 10/2003 |
| JP | 2004-176774 | A | 6/2004 |
| JP | 2008-094991 | A | 4/2008 |
| JP | 2008-274091 | A | 11/2008 |
| JP | 2009-013351 | A | 1/2009 |
| JP | 2009-155443 | A | 7/2009 |
| JP | 2009-209179 | A | 9/2009 |

(Continued)

OTHER PUBLICATIONS

English translation of Written Opinion for corresponding International Application No. PCT/JP2017/026102 dated Aug. 29, 2017.

(Continued)

*Primary Examiner* — James C Goloboy

(74) *Attorney, Agent, or Firm* — Pearne & Gordon LLP

(57) ABSTRACT

The present disclosure is related to provide a lubricating grease composition having a high static friction coefficient while maintaining excellent low-temperature torque characteristics, high-temperature shear stability, and high-temperature oil separation characteristics.

A lubricating grease composition of the present disclosure contains a base oil, a thickener, and a solid lubricant, wherein the solid lubricant is calcium carbonate, the amount of the calcium carbonate blended is 1 to 60% by weight based on the total weight of the lubricating grease composition, the calcium carbonate has an average particle diameter of 0.1 to 30 μm, the base oil has a kinematic viscosity of 18 to 300 $mm^2/s$ at 40° C., and the lubricating grease composition has a worked penetration of 240 to 320.

5 Claims, No Drawings

(56) References Cited

FOREIGN PATENT DOCUMENTS

JP 2009-209180 A 9/2009

OTHER PUBLICATIONS

International Preliminary Report on Patentability for corresponding International Application No. PCT/JP2017/026102 dated Feb. 12, 2019.
International Search Report for corresponding International Application No. PCT/JP2017/026102 dated Aug. 27, 2017.
Written Opinion for corresponding International Application No. PCT/JP2017/026102 dated Aug. 27, 2017.
German Office Action dated Jan. 22, 2020 for corresponding German Application No. 11 2017 003 959.2 and English translation.

* cited by examiner

LUBRICATING GREASE COMPOSITION

CROSS REFERENCE TO RELATED APPLICATIONS

The present application is a continuation application of International Patent Application No. PCT/JP2017/026102 filed on Jul. 19, 2017, which claims priority to Japanese Patent Application No. 2016-155404, filed on Aug. 8, 2016. The contents of these applications are incorporated herein by reference in their entirety.

BACKGROUND

Technical Field

The present disclosure relates to a lubricating grease composition having a high static friction coefficient while maintaining excellent low-temperature torque characteristics, high-temperature shear stability, and high-temperature oil separation characteristics.

Background Art

Greases have been conventionally used as lubricants used for gears and sliding parts. In recent years, resin members have been increasingly used for the gears and the sliding parts in automobile parts, home electronics, electronic information instruments, office automation appliances, and the like, for the purpose of weight saving and cost saving. Among these, the grease used for a sliding portion between resin members or between a resin member and a metal member is required to have excellent low-temperature torque characteristics, high-temperature shear stability, and high-temperature oil separation characteristics. In recent years, in reduction gear parts and the like in reducers in automobiles and office automation appliances, the grease has also been required to have a high static friction coefficient for preventing sliding during quiescence.

For example, the present applicant proposed a lubricating grease composition used for a sliding portion between resin members or between a resin member and a metal member in Japanese Patent Application Laid-Open No. 2009-13351.

However, the lubricating grease composition disclosed in Japanese Patent Application Laid-Open No. 2009-13351 is developed as a lubricating grease composition having a lubricating function (low dynamic friction coefficient) as well as a quiescence function (high static friction coefficient), but the lubricating grease composition has room for improvement.

The present disclosure is related to providing a lubricating grease composition having a high static friction coefficient while maintaining excellent low-temperature torque characteristics, high-temperature shear stability, and high-temperature oil separation characteristics.

SUMMARY

Aspects of the present disclosure are as follows.

A lubricating grease composition according to one aspect of the present disclosure contains a base oil, a thickener, and a solid lubricant, wherein the solid lubricant is calcium carbonate, an amount of the calcium carbonate blended is 1 to 60% by weight based on a total weight of the lubricating grease composition, the calcium carbonate has an average particle diameter of 0.1 to 30 μm, the base oil has a kinematic viscosity of 18 to 300 $mm^2/s$ at 40° C., and the lubricating grease composition has a worked penetration of 240 to 320.

It is preferred that the base oil be at least one oil of a mineral oil and a synthetic hydrocarbon oil.

It is preferred that the thickener be at least one compound of a metal soap-based compound and a complex metal soap-based compound.

It is preferred that the lubricating grease composition be used for a sliding portion between resin members or between a resin member and a metal member.

DESCRIPTION OF EMBODIMENTS

A lubricating grease composition according to the present disclosure contains a base oil, a thickener, and a solid lubricant.

A lubricating grease composition of the present disclosure has a high static friction coefficient while maintaining excellent low-temperature torque characteristics, high-temperature shear stability, and high-temperature oil separation characteristics. In particular, the lubricating grease composition is suitable for use in a sliding portion between resin members or between a resin member and a metal member.

Examples of the base oil used for the present disclosure include, but are not particularly limited to, a mineral oil and a synthetic hydrocarbon oil. The base oils may be used singly, or used in mixtures. Examples of the mineral oil include a paraffin-based hydrocarbon, a naphthene-based hydrocarbon, an aromatic hydrocarbon, and an olefin-based hydrocarbon. Examples of the synthetic hydrocarbon oil include poly-α-olefin, an ethylene-α-olefin copolymer, polybutene, alkylbenzene, and alkyl naphthalene. Among these, poly-α-olefin is preferred.

The kinematic viscosity of the base oil is 18 to 300 $mm^2/s$ at 40° C. When the kinematic viscosity of the base oil is less than 18 $mm^2/s$ at 40° C., high-temperature oil separation characteristics decrease. On the other hand, when the kinematic viscosity of the base oil exceeds 300 $mm^2/s$ at 40° C., low-temperature torque characteristics deteriorate, resulting in no smooth sliding under a low-temperature environment. The kinematic viscosity of the base oil can be measured in accordance with JIS K 2283.

Examples of the thickener used for the present disclosure include, but are not particularly limited to, a metal soap-based compound and a complex metal soap-based compound. The thickeners may be used singly, or used in mixtures. Examples of the metal soap-based compound include a Li soap, a Ca soap, and an aluminum soap, and among these, the Li soap is preferred. Examples of the Li soap include lithium salts of aliphatic monocarboxylic acids having 12 to 24 carbon atoms and lithium salts of aliphatic monocarboxylic acids containing at least one hydroxy group and having 12 to 24 carbon atoms. Lithium salts of stearic acid and 12-hydroxy stearic are particularly preferred. Examples of the complex metal soap-based compound include a Li complex soap, a Ca complex soap, and a Ba complex soap, and among these, the Li complex soap and the Ba complex soap are preferred. Examples of the Li complex soap include lithium salts of aliphatic monocarboxylic acids with aliphatic dicarboxylic acids and lithium salts of two or more aliphatic monocarboxylic acids. Examples of the Ba complex soap include salts of aliphatic dicarboxylic acids with carboxylic acid amides.

The solid lubricant used for the present disclosure is calcium carbonate. The amount of the calcium carbonate blended is 1 to 60% by weight based on the total weight of the lubricating grease composition. When the amount of the calcium carbonate blended is less than 1% by weight based on the total weight of the lubricating grease composition, the static friction coefficient of the lubricating grease composition is small. As a result, when the lubricating grease composition is used for a sliding portion between resin members or between a resin member and a metal member, sliding during quiescence cannot be prevented. On the other hand, when the amount of the calcium carbonate blended exceeds 60% by weight based on the total weight of the lubricating grease composition, the lubricating grease composition is too hard, causing decreased low-temperature torque characteristics. The average particle diameter of the calcium carbonate is 0.1 to 30 μm. When the average particle diameter of the calcium carbonate is less than 0.1 μm, the static friction coefficient of the lubricating grease composition is small. As a result, when the lubricating grease composition is used for a sliding portion between resin members or between a resin member and a metal member, sliding during quiescence cannot be prevented. On the other hand, when the average particle diameter of the calcium carbonate exceeds 30 μm, the calcium carbonate cannot be uniformly dispersed in the lubricating grease composition, causing a high worked penetration and decreased high-temperature oil separation characteristics.

The worked penetration of the lubricating grease composition according to the present disclosure is 240 to 320. When the worked penetration is less than 240, low-temperature torque characteristics deteriorate, resulting in no smooth sliding under a low-temperature environment. On the other hand, when the worked penetration exceeds 320, high-temperature oil separation characteristics decrease. The worked penetration can be measured in accordance with the measuring method specified in JIS K 2220 7.

The lubricating grease composition according to the present disclosure may contain an additive in an amount range not affecting the effect of the lubricating grease composition. For example, a known antioxidant, extreme pressure agent, rust preventive, corrosion inhibitor, and viscosity index improver or the like can be suitably selected, and contained.

Examples of the antioxidant include phenol-based antioxidants such as 2,6-ditertiary butyl-4-methylphenol and 4,4'-methylenebis(2,6-ditertiary butylphenol), and amine-based antioxidants such as alkyl diphenylamine, triphenylamine, phenyl-α-naphthylamine, phenothiazine, alkylated phenyl-α-naphthylamine, and alkylated phenothiazine. Additional examples of the antioxidant include phosphoric acid-based antioxidants and sulfur-based antioxidants.

Examples of the extreme pressure agent include phosphorus-based compounds such as phosphate esters, phosphite esters, and phosphate amine salts, sulfur compounds such as sulfides and disulfides, sulfur-based metal salts such as dialkyldithiophosphoric acid metal salts and dialkyldithiocarbamic acid metal salts, and chlorine compounds such as chlorinated paraffins and chlorinated diphenyls.

Examples of the rust preventive include fatty acids, fatty acid amines, metal sulfonates, alkylsulfonic acid metal salts, alkylsulfonic acid amine salts, oxidized paraffins, and polyoxyethylene alkyl ethers.

Examples of the corrosion inhibitor include benzotriazole, benzimidazole, thiadiazole, and sodium sebacate.

Examples of the viscosity index improver include polymethacrylates, ethylene-propylene copolymers, polyisobutylenes, polyalkylstyrenes, and styrene-isoprene hydrogenated copolymers.

A lubricating grease composition according to one embodiment of the present disclosure contains a base oil, a thickener, and a solid lubricant, wherein the solid lubricant is calcium carbonate, an amount of the calcium carbonate blended is 1 to 60% by weight based on a total weight of the lubricating grease composition, the calcium carbonate has an average particle diameter of 0.1 to 30 μm, the base oil has a kinematic viscosity of 18 to 300 $mm^2/s$ at 40° C., and the lubricating grease composition has a worked penetration of 240 to 320. Therefore, the lubricating grease composition has a high static friction coefficient while maintaining excellent low-temperature torque characteristics, high-temperature shear stability, and high-temperature oil separation characteristics. In particular, the lubricating grease composition is suitable for use in a sliding portion between resin members or between a resin member and a metal member.

EXAMPLES

Hereinafter, a preferred embodiment of the present disclosure will be specifically described based on Examples and Comparative Examples, but the present disclosure is not limited to these Examples.

(1) Method of Preparing Lubricating Grease Composition

Lubricating grease compositions (sample oils) were prepared so that the amounts blended (% by weight) of the following components shown in Tables 1 and 2 were set.

<Base Oil>

Poly-α-olefin A: product name "DURASYN164" (manufactured by INEOS Oligomers Japan, kinematic viscosity at 40° C.: 18 $mm^2/s$)

Poly-α-olefin B: product name "DURASYN166" (manufactured by INEOS Oligomers Japan, kinematic viscosity at 40° C.: 30 $mm^2/s$)

Poly-α-olefin C: product name "DURASYN174" (manufactured by INEOS Oligomers Japan, kinematic viscosity at 40° C.: 390 $mm^2/s$)

Poly-α-olefin D: product name "DURASYN162" (manufactured by INEOS Oligomers Japan, kinematic viscosity at 40° C.: 5 $mm^2/s$)

<Thickener>

Thickener A: Li soap (lithium salt of 12-hydroxy stearic acid)

Thickener B: Ba complex soap (barium salt of sebacic acid with carboxylic acid monostearyl amide)

Thickener C: Li complex soap (lithium salt of 12-hydroxy stearic acid with azelaic acid)

<Solid Lubricant>

Calcium carbonate A: product name "#2000" (manufactured by Sankyo Seifun K.K., average particle diameter: 1.8 μm)

Calcium carbonate B: product name "#200" (manufactured by Sankyo Seifun K. K., average particle diameter: 4.0 μm)

Calcium carbonate C: product name "First Rate" (manufactured by Sankyo Seifun K.K., average particle diameter: 20 μm)

Calcium carbonate D: product name "SFT-2000" (manufactured by Sankyo Seifun K.K., average particle diameter: 30 μm)

Calcium carbonate E: product name "Hakuenka CC" (manufactured by SHIRAISHI CALCIUM KAISHA, LTD., average particle diameter: 0.05 μm)

Calcium carbonate F: product name "G-120" (manufactured by Sankyo Seifun K.K., average particle diameter: 50 μm)

Calcium carbonate G: product name "CALSHITEC VIGOT-10" manufactured by SHIRAISHI CALCIUM KAISHA, LTD., average particle diameter: 0.1 μm)

Polyethylene wax: product name "CERAFLOUR929" (manufactured by BYK-Chemie GmbH)

Polytetrafluoroethylene ("PTFE" in Table): product name "Dyneon TF9207Z" (manufactured by Sumitomo 3M Limited)

Melamine cyanurate ("MCA" in Table): product name "MC-6000" (manufactured by Nissan Chemical Industries, Ltd.)

The average particle diameter of the calcium carbonate manufactured by Sankyo Seifun K.K. is a value measured by SALD-2200 (laser diffraction type, wet type) manufactured by Shimadzu Corporation. The average particle diameter of the calcium carbonate manufactured by SHIRAISHI CALCIUM KAISHA, LTD. is a value measured by MASTERSIZER 3000 (laser diffraction type, wet type) manufactured by Malvern Instruments Ltd.

<Antioxidant>

Phenyl naphthylamine: product name "VANLUBE81" (manufactured by Sanyo Chemical Industries, Ltd.)

<Rust Preventive>

Neutral calcium sulfonate: product name "NA-SUL CA-1089" (manufactured by KING Industries, Inc.)

Specifically, when a sample oil containing a thickener A was prepared, a base oil, 12-hydroxy stearic acid, and lithium hydroxide were first added to a mixing and stirring tank. The amounts of the 12-hydroxy stearic acid and lithium hydroxide blended based on the total amount of the thickener were respectively adjusted to 88% by weight and 12% by weight. The components were stirred while being heated at about 80 to 130° C. to perform a saponification reaction. After performing the saponification reaction, the reaction product was heated to 200° C., and then cooled. The remaining components were added to the produced gel-like substance, followed by stirring, and the resultant mixture was then kneaded using a roll mill or a high-pressure homogenizer to obtain a sample oil.

When a sample oil containing a thickener B was prepared, a base oil, sebacic acid, and sebacic acid monostearyl amide were first added to a mixing and stirring tank, followed by stirring while heating at about 80 to 200° C. Barium hydroxide was added to perform a saponification reaction. The amounts of the sebacic acid, sebacic acid monostearyl amide, and barium hydroxide blended based on the total amount of the thickener were respectively adjusted to 27.5% by weight, 41.5% by weight, and 31% by weight. After performing the saponification reaction, the reaction product was cooled. The remaining components were added to the produced gel-like substance, followed by stirring, and the resultant mixture was then kneaded using a roll mill or a high-pressure homogenizer to obtain a sample oil.

When a sample oil containing a thickener C was prepared, a base oil, 12-hydroxy stearic acid, and lithium hydroxide were first added to a mixing and stirring tank. The components were stirred while being heated at about 80 to 130° C. to perform a saponification reaction. Azelaic acid was added, followed by stirring while heating at 80 to 200° C. to perform a saponification reaction again. The amounts of the 12-hydroxy stearic acid, azelaic acid, and lithium hydroxide blended based on the total amount of the thickener were respectively adjusted to 63.5% by weight, 19% by weight, and 17.5% by weight. After performing the saponification reaction, the reaction product was cooled. The remaining components were added to the produced gel-like substance, followed by stirring, and the resultant mixture was then kneaded using a roll mill or a high-pressure homogenizer to obtain a sample oil.

(2) Evaluation Method (2-1) High-Temperature Oil Separation Characteristics

The degree of oil separation was calculated under conditions of a test temperature of 120° C. for a test time of 24 hours in accordance with "11 Test Method for the Degree of Oil Separation" specified in JIS K 2220:2013.

(2-2) Low-Temperature Torque Characteristics

The starting torque was measured under conditions of a test temperature of −40° C. in accordance with "18 Test Method for Low-Temperature Torque" specified in JIS K 2220:2013.

(2-3) High-Temperature Shear Stability

Using a rheometer (manufactured by Anton Paar GmbH), a shear viscosity was measured under of conditions of a measurement temperature of 100° C. The shear viscosity is a viscosity at a shear rate of 600 $s^{-1}$ when the shear rate is gradually increased from 0 $s^{-1}$ to 600 $s^{-1}$ in a state. In the state, a sample oil is sandwiched between a cone having an angle of 2 degrees and a plate.

(2-4) Static Friction Coefficient

A sample oil was applied on a lower specimen using a reciprocating tester, and an upper specimen and the lower specimen were reciprocated in a state. In the state, the upper specimen was pressed to the lower specimen from above. A static friction coefficient was measured from a frictional force occurring between the upper specimen and the lower specimen during reciprocating. The test conditions will be shown below.

Upper specimen: polyoxymethylene (POM) ball having diameter of 10 mm

Lower specimen: carbon steel (S45C) plate

Test force: 3 kgf

Amount of sample oil applied: 0.05 g

Sliding rate: 1 mm/sec

Test temperature: 80° C.

Sliding distance: 10 mm (3) Evaluation Results

The evaluation results are shown in Tables 1 and 2.

TABLE 1

| | Reference Example 1 | Reference Example 2 | Example 1 | Example 2 | Reference Example 3 | Example 3 | Reference Example 4 |
|---|---|---|---|---|---|---|---|
| Poly-α-olefin A | 83.5 | | | | | | 37.5 |
| Poly-α-olefin B | | 70.5 | 58.5 | 20.5 | 27.5 | 6.5 | |
| Poly-α-olefin C | | | | | 28 | 32 | |
| Thickener A | 10 | 8 | | | | | 11 |
| Thickener B | | | 30 | 28 | | 30 | |
| Thickener C | | | | | 13 | | |
| Calcium carbonate A | | | | | | | |
| Calcium carbonate B | 5 | | | | 30 | | 50 |
| Calcium carbonate C | | | 10 | 50 | | 30 | |

TABLE 1-continued

| | | | | | | | |
|---|---|---|---|---|---|---|---|
| Calcium carbonate D | | 20 | | | | | |
| Calcium carbonate G | | | | | | | |
| MCA | | | | | | | |
| Antioxidant | 1 | 1 | 1 | 1 | 1 | 1 | 1 |
| Rust preventive | 0.5 | 0.5 | 0.5 | 0.5 | 0.5 | 0.5 | 0.5 |
| Total | 100 | 100 | 100 | 100 | 100 | 100 | 100 |
| Base oil (kinematic viscosity at 40° C.) | 18 | 30 | 30 | 30 | 100 | 260 | 18 |
| Worked penetration | 265 | 285 | 290 | 270 | 280 | 282 | 250 |
| Degree of oil separation (% by weight) | 2.2 | 2.4 | 2.4 | 1.9 | 2.1 | 1.7 | 1.8 |
| Low temperatures torque (N · cm) | 35 | 33 | 29 | 36 | 33 | 42 | 38 |
| Shear viscosity (mPa · s) | 2550 | 2300 | 1800 | 2350 | 2200 | 2600 | 2550 |
| Static friction coefficient | 0.17 | 0.18 | 0.18 | 0.23 | 0.18 | 0.20 | 0.22 |

| | Example 4 | Reference Example 5 | Reference Example 6 | Example 5 | Reference Example 7 | Example 6 |
|---|---|---|---|---|---|---|
| Poly-α-olefin A | | 46.5 | | | | 50.5 |
| Poly-α-olefin B | 21.5 | | 21.5 | 25.5 | 66.5 | |
| Poly-α-olefin C | 21 | | 21 | | | |
| Thickener A | | | 6 | | 7 | |
| Thickener B | 26 | | | 33 | | 28 |
| Thickener C | | 12 | | | | |
| Calcium carbonate A | | 40 | | | | |
| Calcium carbonate B | | | | 40 | 20 | |
| Calcium carbonate C | | | 50 | | | |
| Calcium carbonate D | 30 | | | | | |
| Calcium carbonate G | | | | | | 20 |
| MCA | | | | | 5 | |
| Antioxidant | 1 | 1 | 1 | 1 | 1 | 1 |
| Rust preventive | 0.5 | 0.5 | 0.5 | 0.5 | 0.5 | 0.5 |
| Total | 100 | 100 | 100 | 100 | 100 | 100 |
| Base oil (kinematic viscosity at 40° C.) | 100 | 18 | 100 | 30 | 30 | 18 |
| Worked penetration | 315 | 255 | 315 | 260 | 260 | 265 |
| Degree of oil separation (% by weight) | 2.9 | 2.2 | 2.9 | 2.1 | 2.2 | 2.1 |
| Low temperatures torque (N · cm) | 25 | 36 | 26 | 39 | 37 | 34 |
| Shear viscosity (mPa · s) | 1650 | 2700 | 1300 | 2450 | 2500 | 2600 |
| Static friction coefficient | 0.20 | 0.16 | 0.23 | 0.20 | 0.17 | 0.15 |

TABLE 2

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 | Comparative Example 11 | Comparative Example 12 |
|---|---|---|---|---|---|---|---|---|---|---|---|---|
| Poly-α-olefin A | | | 68 | 8.5 | | | | | | | | |
| Poly-α-olefin B | 63.5 | 21.5 | | | 38.5 | 79.5 | 67.5 | 32 | 27.5 | | | 43.5 |
| Poly-α-olefin C | | | | | | | | 32.5 | 28 | 38.5 | | |
| Poly-α-olefin D | | | | | | | | | | | 38.5 | |
| Thickener A | | | | | | 8 | 5 | 4 | 13 | | | |
| Thickener B | 25 | 27 | 30 | 20 | | | | | | 30 | 30 | |
| Thickener C | | | | | | | | | | | | |
| Calcium carbonate A | | | | | | | | | | | | |
| Calcium carbonate B | | | | | | | | | | 30 | 30 | |
| Calcium carbonate C | | | 0.5 | 70 | 55 | | | | | | | 55 |
| Calcium | | | | | | | | 30 | 30 | | | |

TABLE 2-continued

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 | Comparative Example 11 | Comparative Example 12 |
|---|---|---|---|---|---|---|---|---|---|---|---|---|
| carbonate D | | | | | | | | | | | | |
| Calcium carbonate E | 10 | | | | | | | | | | | |
| Calcium carbonate F | | 50 | | | | | | | | | | |
| Polyethylene wax | | | | | 5 | | | | | | | |
| PTFE | | | | | | 1 | 10 | | | | | |
| MCA | | | | | | 10 | 16 | | | | | |
| Antioxidant | 1 | 1 | 1 | 1 | 1 | 1 | 1 | 1 | 1 | 1 | 1 | 1 |
| Rust preventive | 0.5 | 0.5 | 0.5 | 0.5 | 0.5 | 0.5 | 0.5 | 0.5 | 0.5 | 0.5 | 0.5 | 0.5 |
| Total | 100 | 100 | 100 | 100 | 100 | 100 | 100 | 100 | 100 | 100 | 100 | 100 |
| Base oil (kinematic viscosity at 40° C.) | 30 | 30 | 18 | 18 | 30 | 30 | 30 | 100 | 100 | 390 | 5 | 30 |
| Worked penetration | 265 | 325 | 285 | 240 | 285 | 265 | 220 | 330 | 230 | 290 | 275 | 310 |
| Degree of oil separation (% by weight) | 2.1 | 4.3 | 2.4 | 1.5 | 2.9 | 2.1 | 1.6 | 5.5 | 1.7 | 0.7 | 5.7 | 6.5 |
| Low-temperatures torque (N · cm) | 34 | 27 | 30 | 70 | 22 | 33 | 50 | 28 | 60 | 95 | 28 | 19 |
| Shear viscosity (mPa · s) | 2500 | 800 | 2200 | 2700 | 100 | 2450 | 2750 | 1100 | 2600 | 2800 | 2500 | 80 |
| Static friction coefficient | 0.12 | 0.18 | 0.12 | 0.23 | 0.18 | 0.07 | 0.12 | 0..17 | 0.18 | 0.17 | 0.18 | 0.18 |

From Table 1, it was found that, in Examples 1 to 6, the amount of the calcium carbonate blended is 1 to 60% by weight based on the total weight of the lubricating grease composition, the average particle diameter of the calcium carbonate is 0.1 to 30 μm, the kinematic viscosity of the base oil is 18 to 300 $mm^2/s$ at 40° C., and the worked penetration is 240 to 320, whereby Examples 1 to 6 have excellent low-temperature torque characteristics, high-temperature shear stability, and high-temperature oil separation characteristics, and a high static friction coefficient.

On the other hand, in Comparative Example 1, the average particle diameter of the calcium carbonate was less than 0.1 μm, whereby Comparative Example 1 had a low static friction coefficient of 0.12. It was found that, in Comparative Example 2, the average particle diameter of the calcium carbonate was more than 30 μm, whereby Comparative Example 2 had a high degree of oil separation of 4.3% by weight, a low shear viscosity of 800 mPa·s, poor high-temperature oil separation characteristics, and poor high-temperature shear stability. In Comparative Example 3, the amount of the calcium carbonate blended was less than 1% by weight based on the total weight of the lubricating grease composition, whereby Comparative Example 3 had a low static friction coefficient of 0.12. It was found that, in Comparative Example 4, the amount of the calcium carbonate blended is more than 60% by weight based on the total weight of the lubricating grease composition, whereby Comparative Example 4 has a high low-temperature torque of 70 N·cm and poor low-temperature torque characteristics. In Comparative Example 5, the thickener was not contained in the lubricating grease composition, whereby Comparative Example 5 had a low shear viscosity of 100 mPa·s, resulting in poor high-temperature shear stability. In Comparative Example 6, PTFE and MCA were contained in the lubricating grease composition in place of the calcium carbonate, whereby Comparative Example 6 had a low static friction coefficient of 0.07. In Comparative Example 7, as with Comparative Example 6, PTFE and MCA were contained in the lubricating grease composition in place of the calcium carbonate, and the amounts of PTFE and MCA blended were increased, whereby Comparative Example 7 had a small worked penetration. Comparative Example 7 had a high low-temperature torque of 50 N·cm, poor low-temperature torque characteristics, and a low static friction coefficient of 0.12. It was found that Comparative Example 8 had a worked penetration of more than 320, whereby Comparative Example 8 had a high degree of oil separation of 5.5% by weight and poor high-temperature oil separation characteristics. It was found that Comparative Example 9 had a worked penetration of less than 240, whereby Comparative Example 9 had a high low-temperature torque of 60 N·cm and poor low-temperature torque characteristics. It was found that, in Comparative Example 10, the kinematic viscosity of the base oil was more than 300 $mm^2/s$ at 40° C., whereby Comparative Example 10 had a high low-temperature torque of 95 N·cm and poor low-temperature torque characteristics. It was found that, in Comparative Example 11, the kinematic viscosity of the base oil was less than 18 $mm^2/s$ at 40° C., whereby Comparative Example 11 had a high degree of oil separation of 5.7% by weight and poor high-temperature oil separation characteristics. It was found that, in Comparative Example 12, the thickener was not contained in the lubricating grease composition, whereby Comparative Example 12 had a high degree of oil separation of 6.5% by weight, a low shear viscosity of 80 mPa·s, poor high-temperature oil separation characteristics, and poor high-temperature shear stability.

As described above, a lubricating grease composition according to the present disclosure contains a base oil, a thickener, and a solid lubricant, wherein the solid lubricant is calcium carbonate, the amount of the calcium carbonate blended is 1 to 60% by weight based on the total weight of the lubricating grease composition, the calcium carbonate has an average particle diameter of 0.1 to 30 μm, the base oil has a kinematic viscosity of 18 to 300 $mm^2/s$ at 40° C., and the lubricating grease composition has a worked penetration of 240 to 320. Therefore, the lubricating grease composition has a high static friction coefficient while maintaining excellent low-temperature torque characteristics, high-temperature shear stability, and high-temperature oil separation characteristics.

The lubricating grease composition according to one embodiment is particularly suitable for use in a sliding portion between resin members or between a resin member and a metal member, and can be applied to devices and parts or the like in various industrial fields.

Specifically, the lubricating grease composition according to one embodiment can be widely applied to parts for business machines such as copying machines and printers, power transmission apparatuses such as reducers, speed increasers, gears, chains, and motors, traveling system parts, brake system parts of ABS or the like, steering system parts, driving system parts of converters or the like, auxiliary parts for automobiles such as power window motors, power seat motors, and sunroof motors, electronic information instruments, hinge parts for mobile phones or the like, various parts in the food-pharmaceutical industry, the steel, construction, and glass industries, the cement industry, the chemical, rubber, and resin industries of film tenters or the like, the environment-power facility, the paper making-printing industries, the timber industry, the fiber-apparel industry, and relative motion-involving machine parts, or the like. The lubricating grease composition according to one embodiment can also be applied to bearings such as ball bearings, thrust bearings, kinetic pressure bearings, resin bearings, and translation bearings.

What is claimed is:

1. A lubricating grease composition comprising:

a total base oil content in the range of 20.5 to 44 weight percent based on a total weight of the lubricating grease composition, the base oil is selected from the group consisting of mineral oil, poly-α-olefin, an ethylene-α-olefin copolymer, polybutene, alkylbenzene, alkyl naphthalene, and a combination thereof;

a Ba complex soap as a thickener, the thickener is 26 to 33% by weight based on a total weight of the lubricating grease composition; and a solid lubricant, characterized in that the solid lubricant is calcium carbonate, an amount of the calcium carbonate blended is 30 to 53.5% by weight based on a total weight of the lubricating grease composition, the calcium carbonate has an average particle diameter of 1.8 to 30 μm, the base oil has a kinematic viscosity of 18 to 300 $mm^2/s$ at 40° C., and the lubricating grease composition has a worked penetration of 240 to 285.

2. The lubricating grease composition according to claim 1, wherein the lubricating grease composition is used for a sliding portion between resin members or between a resin member and a metal member.

3. The lubricating grease composition according to claim 1, wherein an amount of the thickener blended is 26 to 30% by weight based on a total weight of the lubricating grease composition.

4. A lubricating grease composition comprising:

a total base oil content in the range of 20.5 to 44 weight percent based on a total weight of the lubricating grease composition, the base oil consisting of an oil selected from the group consisting of mineral oil, poly-α-olefin, an ethylene-α-olefin copolymer, polybutene, alkylbenzene, alkyl naphthalene, and a combination thereof;

a Ba complex soap as a thickener; and a solid lubricant, characterized in that the solid lubricant is calcium carbonate, an amount of the calcium carbonate blended is 1 to 53.5% by weight based on a total weight of the lubricating grease composition, an amount of the thickener blended is 26 to 33% by weight based on a total weight of the lubricating grease composition, the calcium carbonate has an average particle diameter of 1.8 to 30 μm, the base oil has a kinematic viscosity of 18 to 300 $mm^2/s$ at 40° C., and the lubricating grease composition has a worked penetration of 240 to 285.

5. The lubricating grease composition according to claim 4, wherein the lubricating grease composition is used for a sliding portion between resin members or between a resin member and a metal member.

* * * * *